United States Patent [19]

Sauer

[11] 4,392,016

[45] Jul. 5, 1983

[54] AM STEREO CARRIER REINSERTION

[75] Inventor: Don R. Sauer, San Jose, Calif.

[73] Assignee: National Semiconductor Corporation, Santa Clara, Calif.

[21] Appl. No.: 239,914

[22] Filed: Mar. 2, 1981

[51] Int. Cl.[3] ..... H04H 5/00

[52] U.S. Cl. ..... 179/1 GS; 179/1 GB

[58] Field of Search ..... 179/1 GS, 1 GB, 1 GN

[56] References Cited

U.S. PATENT DOCUMENTS

| | | | |
|---|---|---|---|
| 3,732,375 | 5/1973 | Kuribayashi | 179/1 GS X |
| 4,249,039 | 2/1981 | Fisher et al. | 179/1 GS |
| 4,340,782 | 7/1982 | Weigand et al. | 179/1 GS |

*Primary Examiner*—R. J. Hickey

*Attorney, Agent, or Firm*—Gail W. Woodward; Paul J. Winters; Neil B. Schulte

[57] ABSTRACT

In an AM stereo radio receiver a filter is coupled to the IF amplifier and is tuned to the IF carrier frequency. The filter will ring at the IF and, if desired, can be incorporated into an oscillator circuit. The resulting signal acts as a reinserted carrier that will persist over those intervals during which the carrier would ordinarily be absent due to amplitude overmodulation. In effect the oscillatory signal sets the minimum value to which the carrier can be driven and will act to prevent the noise bursts that ordinarily accompany excessive modulation. Such overmodulation can result from inadvertence at the transmitter or from multipath reception.

5 Claims, 3 Drawing Figures

AM STEREO CARRIER REINSERTION

BACKGROUND OF THE INVENTION

The invention is related to AM stereo ratio receivers. My copending patent application Ser. No. 197,294 was filed Oct. 15, 1980 (now U.S. Pat. No. 4,362,999), is titled "AM STEREO PHASE MODULATION DECODER," and is assigned to the assignee of the present invention. That application discusses AM stereo receivers and details a phase demodulator suitable for recovering the L-R channel information broadcast in AM stereo. The teaching in that application is incorporated herein by reference.

In AM stereo the sum information channel is normally amplitude modulated while the difference information channel is transmitted by phase modulation of the same carrier. In the receiver a limiter-phase detector combination is used to recover the difference information. Unfortunately, in AM broadcasting there is a tendency to operate the transmitters at a fairly high modulation level so that there are occasional overmodulation peaks. During these peaks the phase modulated carrier vanishes and the phase decoder can respond to produce noise spikes. This is particularly true of synchronous phase detectors which are provided with an IF derived carrier from a phase locked loop oscillator. The detector of my copending application Ser. No. 197,294 displays greatly reduced sensitivity to such carrier loss but is not immune thereto.

In AM radio broadcasting it has been discovered that multipath propagation can act to increase the observed degree of carrier modulation. This phenomena can act to aggravate the effects of the normally high percentage of AM broadcast modulation. The resulting increase in apparent noise in AM stereo broadcasting can constitute a problem.

SUMMARY OF THE INVENTION

It is an object of the invention to provide means for reinserting the carrier in an AM stereo receiver to avoid the noise effects of carrier loss in the modulation troughs.

It is a further object of the invention to couple a filter to an AM stereo receiver wherein the filter is tuned to the broadcast carrier and rings at that frequency.

These and other objects are achieved in a stereo AM radio receiver that incorporates a phase modulation decoder for the L-R channel of a stereo broadcast. Basically, a tuned circuit filter is coupled to the limiter that precedes the phase detector in the phase decoder. The filter is tuned to the carrier frequency and can be coupled to any of the receiver signal circuits but the limiter input circuit is preferred. Such a filter will ring at the carrier frequency and will supply the carrier over those intervals during which the carrier ordinarily vanishes due to overmodulation. Thus in those intervals during which noise spikes will ordinarily be produced, the carrier is reinserted and the effect upon the signal response is smoothed out and minimized. If desired, the filler can be made oscillatory so that there is always a minimum carrier signal available to the phase demodulator.

In its preferred embodiment the filter has a very narrow band response that is precisely tuned to the signal carrier. The filter bandwidth is made small enough to exclude the ordinary modulation products and therefore responds only to the carrier signal.

DESCRIPTION OF THE INVENTION

Figure 1:
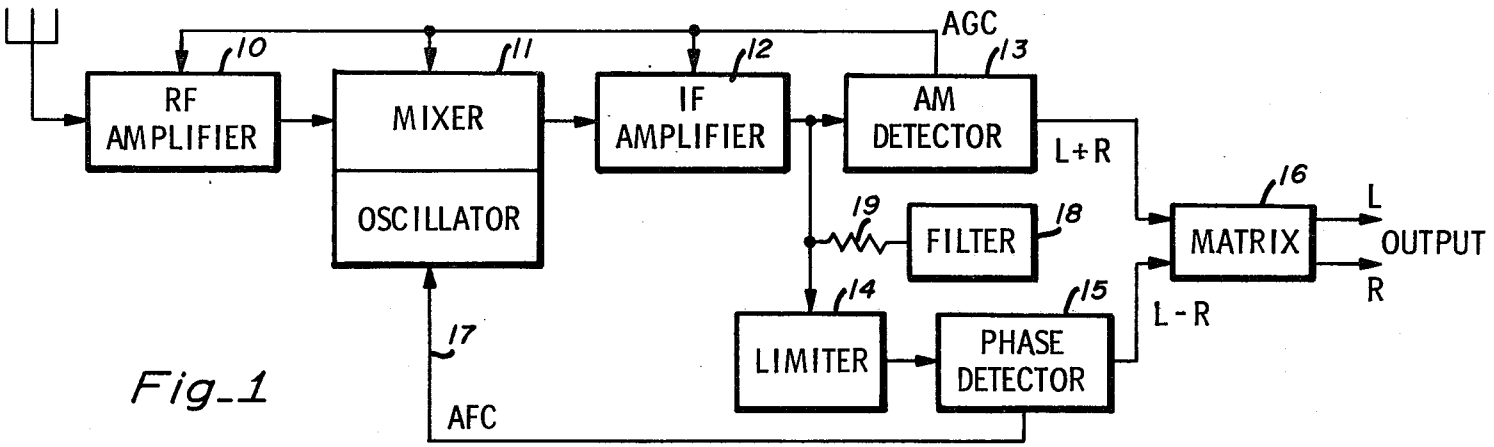
FIG. 1 is a block diagram of an AM stereo broadcast receiver using the invention.

FIG. 1 is a block diagram of an AM stereo radio receiver employing the invention. The receiver components are conventional. An RF amplifier 10 is coupled to a converter 11 which is shown made up of a combination mixer and local oscillator. The converter drives an IF amplifier 12 which is coupled to an AM detector 13 that develops the L+R signal or sum channel. These components comprise the conventional AM receiver which can be used to compatibly reproduce the stereo broadcasts in monaural fashion. For stereo the IF amplifier also drives a limiter 14 which is followed by a phase detector 15 the output of which reproduces the L-R or stereo difference channel. The sum and difference signals are coupled to matrix 16 which produces the L and R stereo audio signals which can be reproduced in a conventional stereo amplifier and speaker system (not shown).

If desired, the phase detector 15 can be used to develop an automatic fine tuning (AFT) voltage which can be coupled via line 17 to the local oscillator. This ensures precise receiver tuning. Alternatively, the local oscillator signal can be synthesized precisely using conventional digital techniques.

It has been found that when the stereo carrier is heavily amplitude modulated at the transmitter, as would occur for relatively loud sounds, the carrier can drop below the level at which limit 14 is effective. For this condition phase detector 15 will see noise and its output will contain undesired noise signals. Furthermore, since multipath signal propagation can act to increase the apparent modulation percentage of an AM signal, its effect can further aggravate the problem. It is to be noted that when overmodulation of the carrier occurs, as the modulation drives the carrier to zero a further modulation increase can produce carrier phase reversals. If the receiver employs a synchronous detector, with a phase locked loop oscillator reference signal, the output can produce rail-to-rail noise spikes.

In accordance with the invention a filter 18 is coupled by means of an attenuator resistor 19 to the input to the limiter 14. Filter 18 employs L-C components tuned to the receiver IF. Actually the filter can be located anywhere in the receiver where a signal carrier is present. However, at the IF only a single frequency is involved. At the connection point shown the signal amplitude is high enough to be handled easily. While a filter is specified, it is preferred that a gain element be associated so that it can be operated in an oscillatory mode. In effect there is an L-C tuned circuit with a shunt negative resistance which, if desired, can dominate the tuned circuit. This means that the filter action of the tuned circuit can have its response narrowed by raising its Q. If the circuit is actually oscillating, the signal injected by the IF amplifier will pull the oscillation into phase lock. Then when the carrier drops out, due to overmodulation, the oscillations will create a reinjected carrier that avoids the previously mentioned noise problem. Even if the circuit is not oscillatory, but merely of high Q, the signal will cause the circuit to ring so that carrier reinjection will occur during the zero carrier intervals in the modulation troughs.

Attenuator 19 isolates filler 18 and determines how much signal transfer occurs. Its value is determined empirically and is selected for the desired degree of noise quieting in the presence of overmodulation. As a practical matter attenuator 19 can be adjusted for the lowest modulation distortion level of an overmodulated signal.

Figure 2:
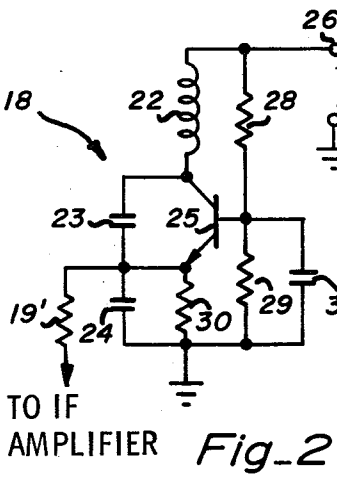
FIG. 2 is a schematic diagram of the filter circuit of FIG. 1.

FIG. 2 is a schematic diagram of a suitable filter. Inductor 22 along with capacitors 23 and 24 is tuned to the receiver IF and forms a colpitts oscillator with transistor 25. The circuit is powered from a power supply coupled between $V_{cc}$ terminal 26 and ground terminal 27. Resistors 28–30 set the transistor d-c bias and operating current. Capacitor 34 bypasses the base of transistor to ground at the signal frequency. This circuit is clearly oscillatory and its frequency is pulled by injection to synchronize with the IF carrier. It will thus be phase modulated to track the stereo L-R channel information.

Figure 3:
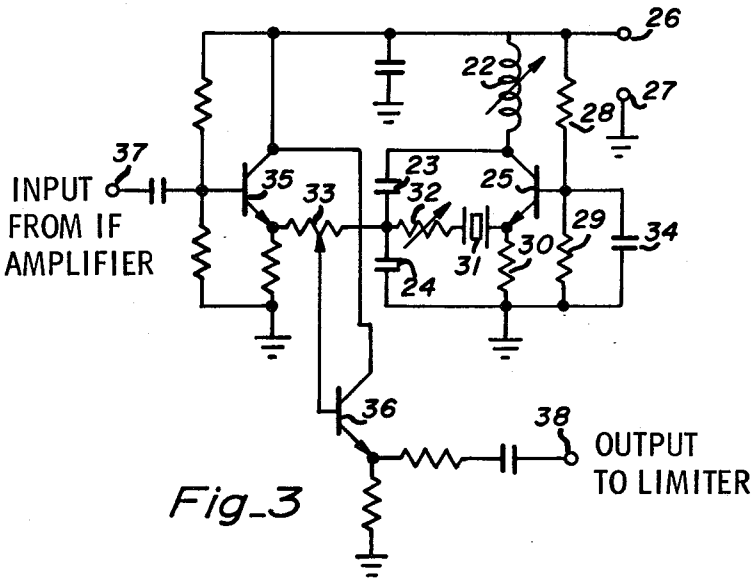
FIG. 3 is a schematic diagram of the preferred embodiment of the invention.

FIG. 3 is a schematic diagram of the preferred embodiment of the invention. Where the parts correspond to those of FIG. 2 the same numbers are used. Transistor 25 is connected to the L-C tank circuit as a colpitts oscillator but resistor 32 and resonator 31 are included in series in the feedback path. Desirably resonator 31 is a quartz crystal. If resistor 32 is set high enough, the circuit will not oscillate but there will be two resonances. The L-C resonance will be obtained normally and resonator 31 will add a second high Q resonance peak thereto.

Transistors 35 and 36 are connected as emitter follower buffers between input terminal 37 and output terminal 38. The setting of potentiometer 33 will vary the degree of coupling between the filter and the signal transfer circuit. When potentiometer 33 has its arm at the left, the filter coupling is minimal. With the arm at the right the filter coupling is maximum. Resistor 32 will vary the effective negative resistance presented by transistor 25 across the two resonant circuits. At some point as resistor 32 is lowered, the circuit will oscillate at the frequency of resonator 31. Below this point the filter characteristic is a broad resonant hump produced by the L-C filter with a midway or secondary narrow hump representing the action of resonator 31. Ideally resonator 31 is precisely tuned to the receiver IF which is electronically controlled to be at the correct frequency. The Q of resonator 31 is high enough so that the modulation products of the IF carrier lie outside its filter passband. Thus, resonator 31 responds only to the receiver IF carrier.

In operation terminal 37 is connected to the output of IF amplifier 12 and terminal 38 is coupled to the input of limiter 14. Thus, the filter acts as a series coupling element in the block diagram. The circuit of FIG. 3 has the advantage of not changing the output of the IF stage 12 even when oscillatory. Thus, there is no signal offset at detector 13.

The invention has been described and its nature detailed. There are alternatives and equivalents that will occur to a person skilled in the art upon reading the foregoing. Accordingly it is intended that the scope of the invention be limited only by the claims that follow.

I claim:

1. In an AM stereo radio receiver that employs amplitude modulation of a carrier signal to transmit the stereo sum signal and phase modulation of said carrier to transmit the stereo difference signal and includes a phase demodulator for recovering said stereo difference signal, the improvement comprising:

filter means tuned to said carrier frequency; and means for coupling said filter means to said receiver whereby said filter normally receives said carrier signal and will act to supply said carrier signal to said receiver during those brief periods of time when said carrier signal would be lost due to amplitude overmodulation.

2. The improvement of claim 1 wherein said filter means further includes an oscillatory signal circuit.

3. The improvement of claim 1 wherein said filter means comprise a narrow band tuned circuit which has a bandwidth that excludes the modulation of said carrier and said receiver includes means for precision tuning of said receiver frequency.

4. The improvement of claim 3 wherein said filter means further includes a wide band tuned circuit.

5. The improvement of claim 4 wherein said narrow and wide band tuned circuits are combined within a variable gain amplifier feedback circuit.

* * * * *